US008020229B2

(12) United States Patent
Sato

(10) Patent No.: US 8,020,229 B2
(45) Date of Patent: Sep. 20, 2011

(54) PILLOW

(76) Inventor: Kenjiro Sato, Okayama (JP)

( * ) Notice: Subject to any disclaimer, the term of this patent is extended or adjusted under 35 U.S.C. 154(b) by 363 days.

(21) Appl. No.: 12/225,635

(22) PCT Filed: Feb. 22, 2007

(86) PCT No.: PCT/JP2007/053257

§ 371 (c)(1),
(2), (4) Date: Sep. 26, 2008

(87) PCT Pub. No.: WO2007/111064

PCT Pub. Date: Oct. 4, 2007

(65) Prior Publication Data

US 2010/0229307 A1 Sep. 16, 2010

(30) Foreign Application Priority Data

Mar. 29, 2006 (JP) ..... 2006-091883

(51) Int. Cl.
*A47C 9/10* (2006.01)

(52) U.S. Cl. ..... 5/636; 5/630

(58) Field of Classification Search ..... 5/636–640, 5/630

See application file for complete search history.

(56) References Cited

U.S. PATENT DOCUMENTS

| | | | | |
|---|---|---|---|---|
| 7,082,633 | B1 * | 8/2006 | Maarbjerg | 5/636 |
| 7,316,041 | B2 * | 1/2008 | Guez | 5/636 |

FOREIGN PATENT DOCUMENTS

| | | |
|---|---|---|
| JP | 56-117871 | 9/1981 |
| JP | 1-126166 | 8/1989 |
| JP | 3-13875 | 2/1991 |
| JP | 303810 | 2/1997 |
| JP | 11-342057 | 12/1999 |
| JP | 2001-178755 | 7/2001 |

* cited by examiner

*Primary Examiner* — Fredrick Conley
(74) *Attorney, Agent, or Firm* — DLA Piper LLP (US)

(57) ABSTRACT

A pillow for enabling a patient with whiplash syndrome to sleep peacefully including a deformable pillow body having an upper surface cloth and a lower surface cloth with an edge cloth as a boundary, a depression part including a bottom surface at a position depressed from the upper surface cloth to the lower surface cloth of the pillow body and a grooved part extending from the depression part to the edge cloth of the pillow body and being formed by joining the upper surface cloth to the lower surface cloth.

8 Claims, 8 Drawing Sheets

PILLOW

TECHNICAL FIELD

The present invention relates to a pillow used by patients with whiplash syndrome without placing a strain on the neck.

BACKGROUND ART

Patients with whiplash syndrome have problems especially in that a strain is placed on the neck and they are not able to sleep peacefully with a normal pillow. Patent Document 1 proposes a cervical spine correcting tool of a pillow shape with elasticity formed with a concave part for placing a correcting part at the middle of a top surface, where a space is provided at the middle of the bottom surface, and the middle of the bottom surface lowers by the load on the top surface when the correcting part is placed on the top surface thereby narrowing the concave part. The cervical spine correcting tool has an effect of treating whiplash syndrome by restricting the orientation of the neck to a constant.

[Patent Document 1] Japanese Laid-Open Patent Publication No. 2001-178755

DISCLOSURE OF THE INVENTION

Problem to be Solved by the Invention

In order to make the patient with whiplash syndrome sleep peacefully, usage of a combination of the cervical spine correcting tool of Patent Document 1 and the normal pillow is probable. However, the cervical spine tool of Patent Document 1 is aimed to correct the bend of the neck caused by the whiplash syndrome, and does not bring peaceful sleep to a sick person. If the patient with whiplash syndrome is able to sleep peacefully, it follows that the patient is sleeping at appropriate orientation. Therefore, if a pillow enabling the sick parson to sleep at the appropriate orientation is realized, the sick person can sleep peacefully, and furthermore, the pillow may contribute to a remedy of the whiplash syndrome. Thus, a pillow enabling the patient with whiplash syndrome to sleep peacefully is reviewed for development.

Means for Solving the Problem

As a result of the review, a deformable pillow including an upper surface and a lower surface with an outer edge as a boundary has been developed. This pillow includes a head depression part having a bottom surface at a position depressed from the upper surface towards the lower surface of a pillow body, and a groove part extending from the head depression part to the outer edge of the pillow body and being formed by joining the upper surface to the lower surface. A case where the patient with whiplash syndrome uses the pillow of the present invention will be explained below.

The pillow of the present invention is used by placing the back of the head of the patient with whiplash syndrome on the head depression part and laying the neck of the patient with whiplash syndrome along the groove part. In this case, the head depression part fixes the position and the orientation of the back of the head of the patient with whiplash syndrome on the pillow body, and the groove part eliminates the risk of the neck of the patient with whiplash syndrome contacting the pillow body. In the pillow of the present invention, the pillow body on the left and the right of the groove part extending from the head depression part forms an inclined surface (slope) gradually rising from the head depression part, so that the pillow body is fitted from the back of the head to the neck without placing a strain on the neck, thereby fixing the position of the back of the head and the neck of the patient with whiplash syndrome.

The head depression part may be configured including a bottom surface in plane with the lower surface of the pillow body, and a supporting surface raised from a periphery of the bottom surface towards the upper surface of the pillow body, and the groove part extends from the bottom surface to the outer edge of the pillow body. The supporting surface is basically configured as a continuous peripheral surface surrounding the head depression part while sandwiching the groove part. The supporting surface may also be formed with a separation part extending from the head depression part to the outer edge of the pillow body other than the groove part so as to be divided by the separation part, and the respective surface may be configured as a discontinuous peripheral surface including a plurality of inclined surfaces of falling gradient towards the head depression part. The head depression part has the bottom surface in plane with the lower surface of the pillow body, so that the supporting surface supports the back of the head as continuous or discontinuous peripheral surface while deeply sinking the back of the head of the patient with whiplash syndrome, thereby fixing the position and the orientation of the back of the head of the patient with whiplash syndrome. If said head depression part is an opening passing through the pillow body, the supporting surface opens to the left and the right and cannot support the back of the head of the patient with whiplash syndrome, and may place a strain on the neck of the patient with whiplash syndrome. The bottom surface of the head depression part has a function of preventing the supporting surface from opening to the left and the right, and holding the shape of the entire head depression part. In addition, the back of the head may contact the bottom surface of the head depression part depending on the patient with whiplash syndrome. In this case a thin cushion sheet may be accommodated and used at the head depression part as necessary.

The head depression part preferably has the bottom surface of a bell shape in plain view surrounded by a linear lower edge orthogonal to an extending direction of the groove part, linear side edges extending in a relation intersecting the lower edge from both ends of the lower edge, and an arch-shaped upper edge bridged between ends of the both side edges. The linear side edges and the arch-shaped upper edge form the supporting surface as the continuous or discontinuous peripheral surface enveloping the back of the head of the patient with whiplash syndrome, and stably supports the back of the head of the patient with whiplash syndrome. The linear lower edge orthogonal in the extending direction of the groove part at the bottom surface of bell shape in plain view provides an inclined surface of wide width that does not place a strain on the neck even if the patient with whiplash syndrome moves to the left or the right by uniformly forming the inclined surface of rising gradient formed along the groove part from the head depression part at the width of the lower edge.

The head depression part may have the bottom surface formed to an elliptical shape in plane view surrounded by an arcuate lower edge orthogonal to an extending direction of the groove part, linear side edges extending in continuation to the lower edge from both ends of the lower edge, and an arch-shaped upper edge bridged between the ends of both side edges. The arcuate lower edge orthogonal in the extending direction of the groove part at the bottom surface of the elliptical shape in plain view has the inclined surface of rising gradient formed along the groove part from the head depression part so as to envelope the neck of the patient with whiplash syndrome, thereby restraining the back of the head of the patient with whiplash syndrome without placing a strain on the neck of the patient with whiplash syndrome. Which head depression part is preferable depends on the degree of symptoms and the preference of the patient with whiplash syndrome.

The groove part is the portion where the upper surface of the pillow body is depressed towards the lower surface. However, since the upper surface and the lower surface of the pillow body are folded back or bounded at the outer edge, if the groove part is simply formed from the head depression part towards the outer edge, both sides at the terminating end of the groove part intersecting the outer edge may project out and pop out, and both sides of the terminating edge may stimulate the neck of the patient with whiplash syndrome. The groove part is thus formed with a cutout portion by cutting both sides at the terminating end intersecting the outer edge of the pillow body to the left and the right so that the projection forms at a position slightly retreated from the outer edge, thus preventing both sides of the terminating end of the groove part from popping out.

The pillow of the present invention has a structure including the head depression part and the groove part in the pillow body, so that an effect that the patient with whiplash syndrome can sleep peacefully is obtained. In view of the actual usage mode of the pillow, the pillow body is preferably prevented from becoming dirty, and thus a pillowcase is desirably attached. However, with the pillowcase to be placed over the pillow body known in the prior art and the pillowcase of tubular shape or bag shape for covering the pillow body, the pillowcase becomes tense and bridges over the groove part of the pillow body, and thus the pillowcase may apply pressure on the neck of the patient with whiplash syndrome. The pillow body of the present invention is thus covered with the pillowcase covering at least the upper surface, the pillowcase being formed with an opened cutout at a position corresponding to both sides of the terminating end where the groove part of the pillow body intersects the outer edge.

The cutout formed at the peripheral edge of the pillowcase eliminates the tension applied to the pillowcase, and the pillowcase is tucked into the groove part of the pillow body coincided with the position formed with the cutout, thereby avoiding the application of pressure on the neck of the patient with whiplash syndrome by the pillowcase. "Opened cutout" refers to a structure in which a cutout is formed from the peripheral edge of the pillowcase and the peripheral edge of the pillowcase is opened to the left and the right in a range of the cutout. The cutout of the pillowcase becomes a mark with respect to both sides of the terminating end of the groove part intersecting the outer edge, and the attachment position of the pillowcase with respect to the pillow body can be easily determined.

The pillow body may also be covered by a tubular or a bag-shaped pillowcase. The pillowcase is formed with a closed cutout at a position corresponding to both sides of the terminating end where the groove part of the pillow body intersects the outer edge of the pillow body. The cutout formed in the tubular or the bag-shaped pillowcase prevents application of pressure on the neck of the patient with whiplash syndrome by making the pillowcase tucked in along the groove part as in the similar way mentioned above. The closed cutout serves as a mark with respect to the cutout portion formed on both sides of the terminating end of the groove part intersecting the outer edge. "Closed cutout" refers to a structure in which the cutout is the opening formed in the pillowcase, and the cutout is opened to the left and the right in a range of deforming the opening shape.

The pillow body of the present invention is formed by filling movable filler in a bag body having the head depression part and the groove part, or is formed by an elastic resin integrated molded article formed with the head depression part and the groove part. The former pillow body in which the filler is filled in the bag body, the filler does not move in the region formed with the head depression part and the groove part, but the filler is freely movable to the upper side of the head depression part, that is, upside-down positional relationship with respect to the groove part, and in particular, the extent of inclination and swelling of the supporting surface of the head depression part can be adjusted by the movement of the filler. The extent of inclination and swelling of the inclined surface from the head depression part to the groove part can be adjusted by the movement of the filler. On the other hand, in the pillow body formed as an elastic resin integrated molded article, the inclination and the swelling of the supporting surface or the inclined surface cannot be adjusted by the movement of the filler, but, especially, this pillow body is suitable for stably supporting the back of the head of the patient with whiplash syndrome as it excels in maintaining the shape of the head depression part.

Effect of the Invention

The present invention provides a pillow enabling the patient with whiplash syndrome to sleep peacefully. Specifically, the strain is not placed on the neck of the patient with whiplash syndrome while stably maintaining the position and the orientation of the back of the head of the patient with whiplash syndrome with the combination of the head depression part and the groove part, thereby providing a pillow extremely suited for use by the patient with whiplash syndrome, and furthermore, as described above, peaceful sleep of the patient with whiplash syndrome has a meaning of promoting orientation suited for the patient with whiplash syndrome, and thus it is useful in no small extent to the treatment of whiplash syndrome. The present invention thus provides the effect enabling the patient with whiplash syndrome to sleep peacefully and also the treatment effect.

DESCRIPTION OF SYMBOLS

Figure 1:
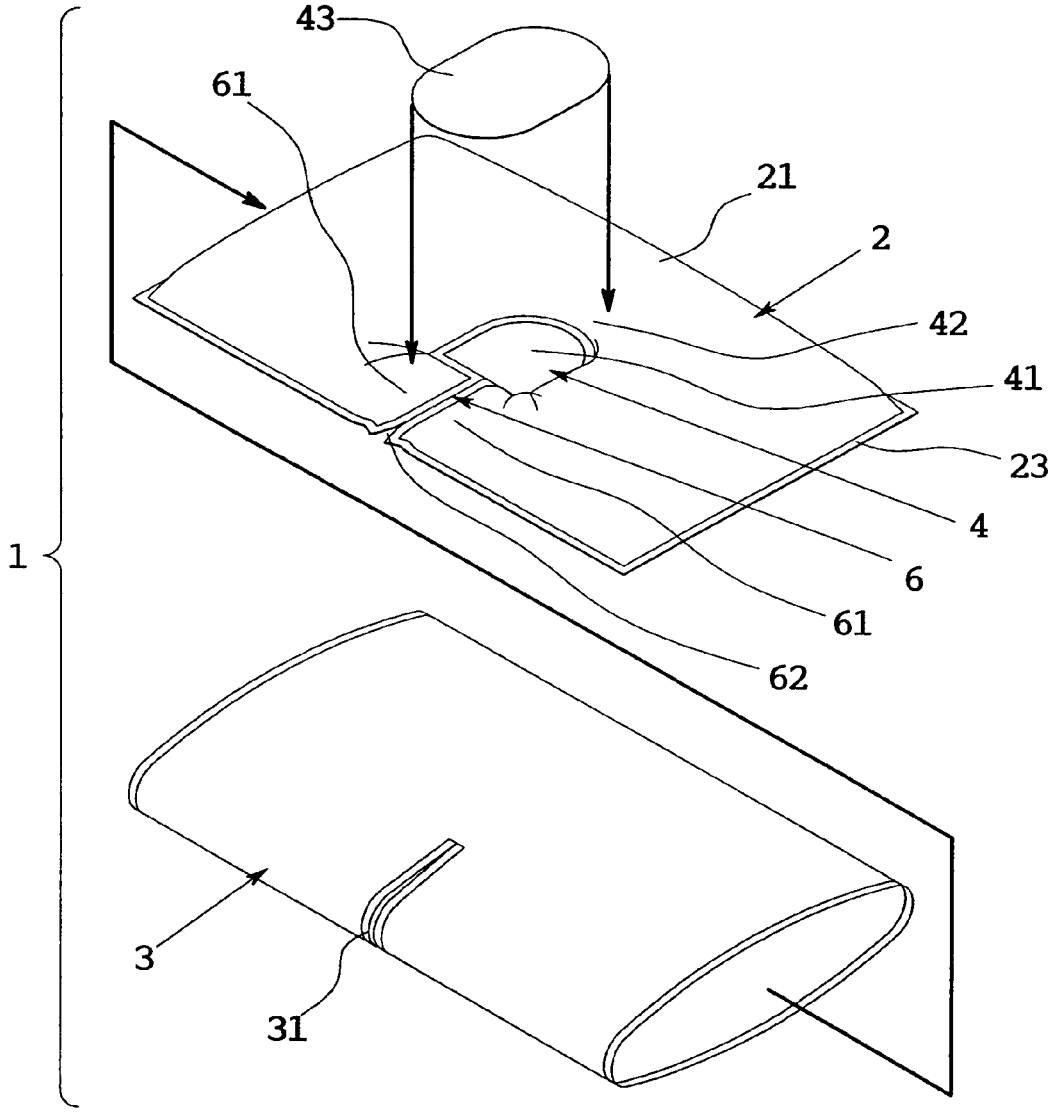
FIG. 1 is a perspective view showing one example of a pillow based on the present invention.

1 Pillow
2 Pillow body
21 Upper surface cloth
22 Lower surface cloth
23 Edge cloth
24 Filler

25 Separation part
3 Pillowcase
31 Cutout
4 Head depression part
41 Bottom surface
42 Supporting surface
43 Cushion sheet
6 Groove part
61 Inclined surface
62 Cutout portion
7 Patient with whiplash syndrome
71 Back of the head
72 Neck

DETAILED DESCRIPTION OF THE PREFERRED EMBODIMENTS

Figure 2:
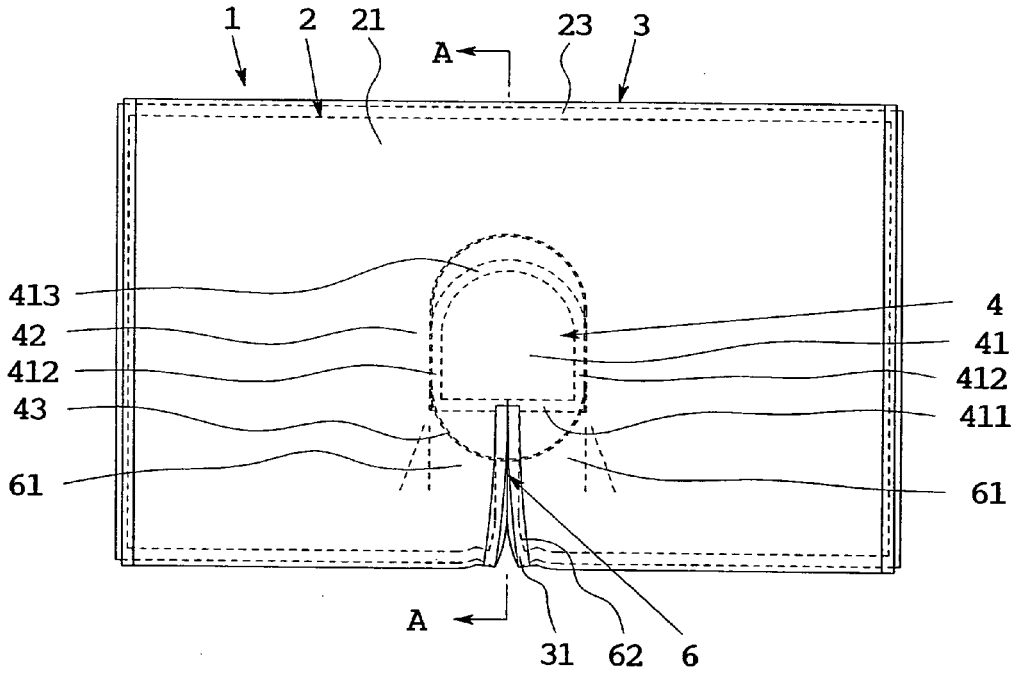
FIG. 2 is a plain view of the pillow of the present example.
Figure 4:
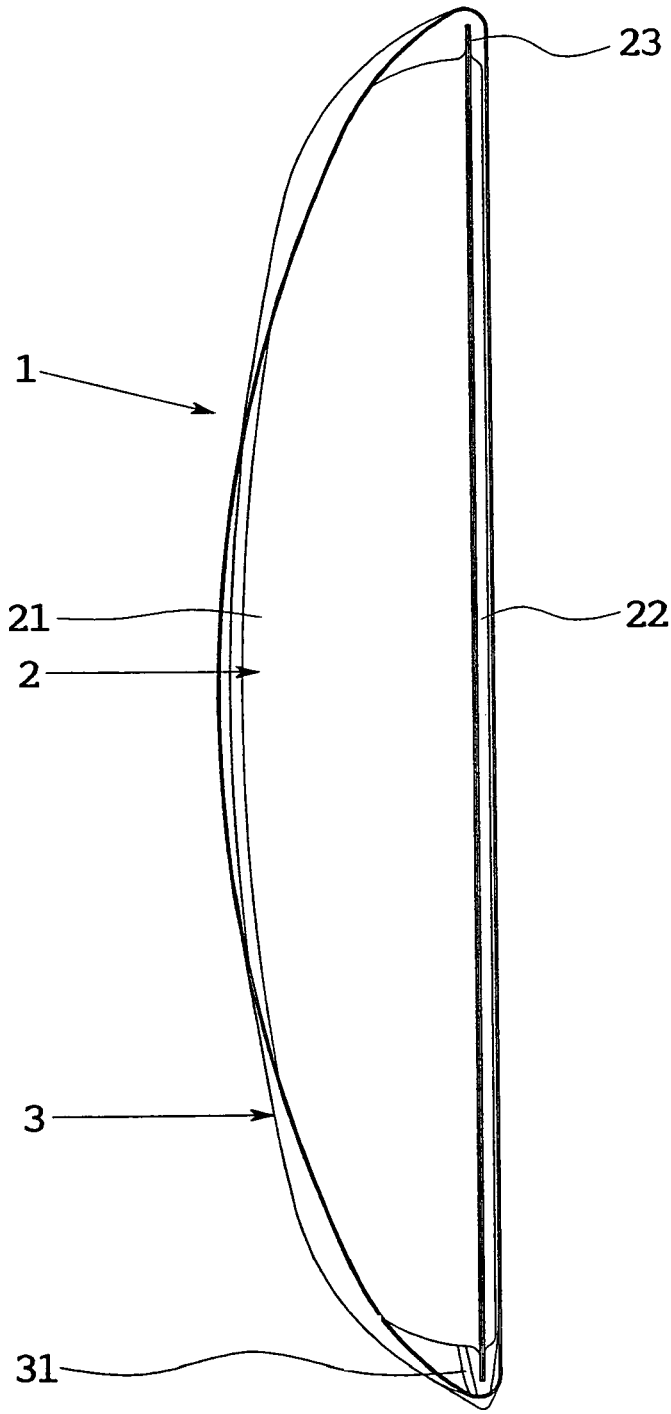
FIG. 4 is a side view of the pillow of the present example.
Figure 5:
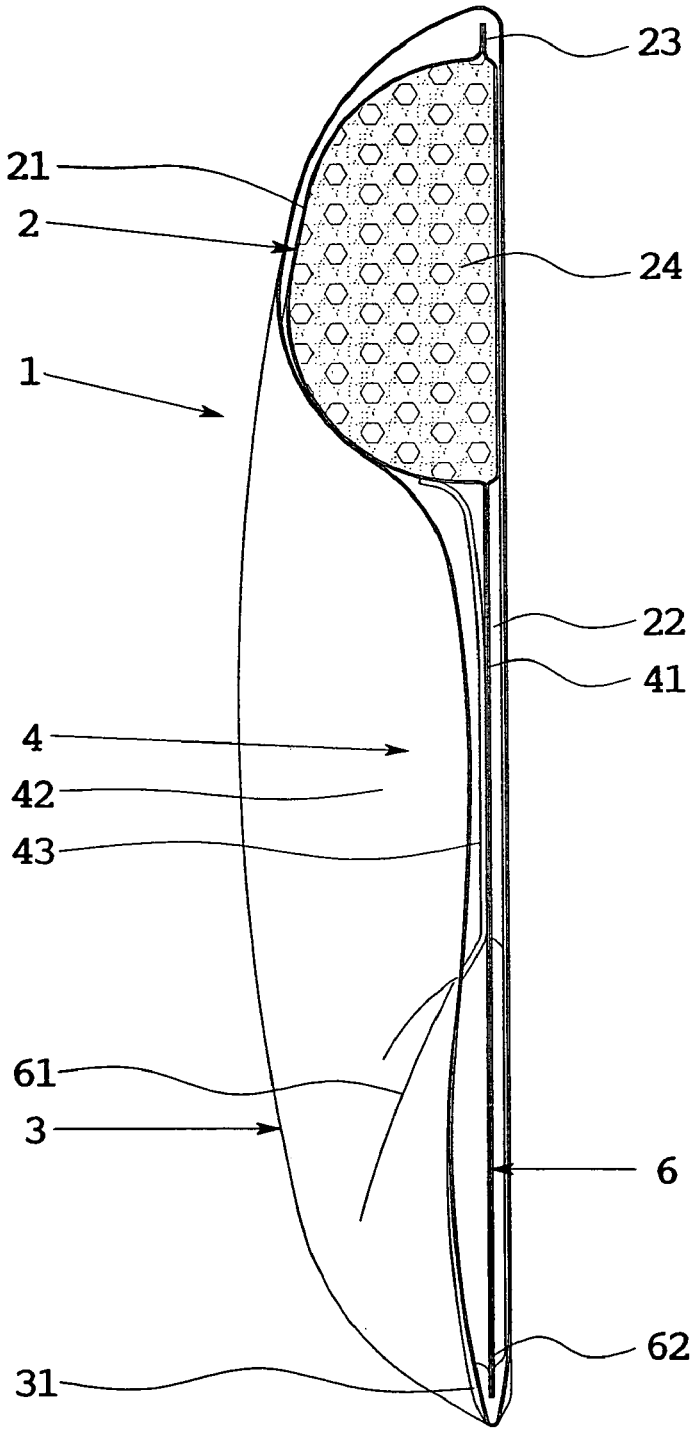
FIG. 5 is a cross-sectional view taken along line A-A in FIG. 2 of the pillow of the present example.
Figure 6:
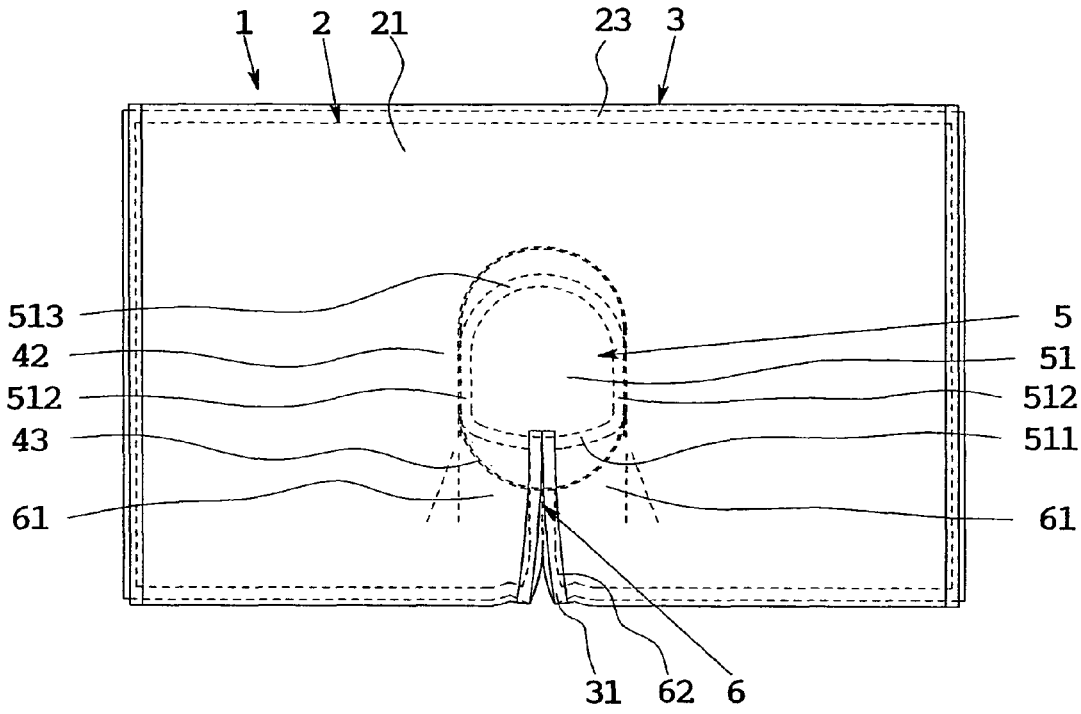
FIG. 6 is a plain view corresponding to FIG. 2 of the pillow having a pillow body formed with a head depression part of another example.
Figure 7:
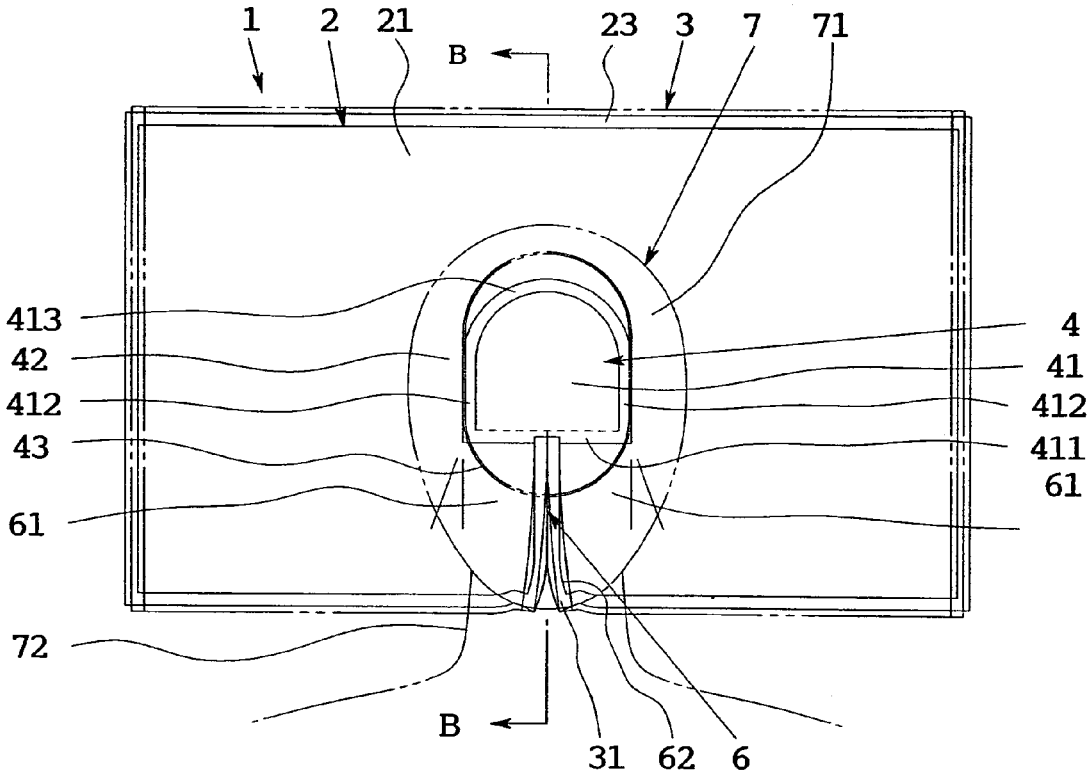
FIG. 7 is a plain view showing a usage state of the pillow of the present example.
Figure 8:
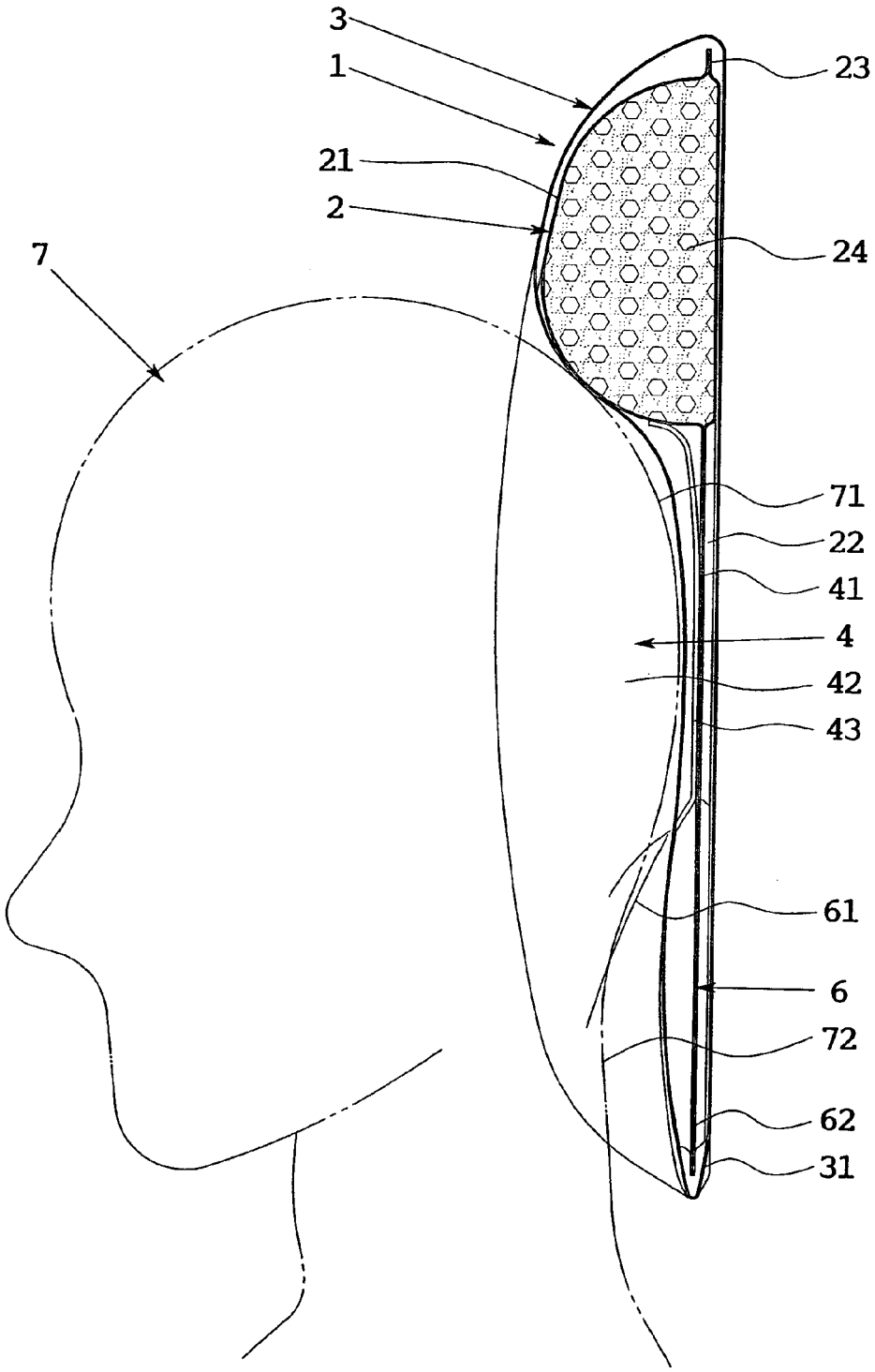
FIG. 8 is a cross-sectional view taken along line B-B of FIG. 7 showing the usage state of the pillow of the present example.

Embodiments of the present invention will be described with reference to the drawings. FIG. 1 is a perspective view showing one example of a pillow 1 based on the present invention, FIG. 2 is a plain view of the pillow 1 of the present example, FIG. 4 is a side view of the pillow 1 of the present example, FIG. 5 is a cross-sectional view taken along line A-A in FIG. 2 of the pillow 1 of the present example, FIG. 6 is a plain view corresponding to FIG. 2 of the pillow 1 having a pillow body 2 formed with a head depression part 5 of another example, FIG. 7 is a plain view showing a usage state of the pillow 1 of the present example, and FIG. 8 is a cross-sectional view taken along line B-B of FIG. 7 showing the usage state of the pillow 1 of the present example. The pillow 1 of the present example has a pillow body 2 of a rectangular shape in plain view, and has an appearance when attached with a pillowcase 3 similar to a conventionally known general pillow, which alleviates the psychological resistance (resistance on he/she being the only one using a specific article) when the patient with whiplash syndrome uses the pillow 1 of the present example.

As shown in FIGS. 1 to 5, the pillow 1 of the present example is the pillow body 2 having a rectangular shape in plain view in which an upper surface and a lower surface with an edge cloth 23 (outer edge) as a boundary are configured by an upper surface cloth 21 and a lower surface cloth 22 sewed at the edge cloth 23 of the outer periphery. The pillow 1 comprises a head depression part (or merely called "depression part") 4 (which is depressed by the head of a patient) having the lower surface cloth 22 as the bottom surface 41 of bell-shape in plain view at the position depressed from the upper surface at the middle to the lower surface at the middle of the pillow body 2, and a groove part 6 extending from the head depression part 4 to the edge cloth 23 of the pillow body 2 and being formed by sewing the upper surface cloth 21 to the lower surface cloth 22. Thus, the sewing line of the upper surface cloth 21 and the lower surface cloth 22 becomes close to a ground surface (surface of the mattress or the bed) of the pillow 1, and the sewing line is less likely to contact the neck of the patient with whiplash syndrome.

The pillow body 2 is formed to a bag in which the interior is communicated excluding the head depression part 4 and the groove part 6, and filler 24 (pipe, beads, buckwheat chaff, etc.) is filled in the interior. The pillow body 2 is freely deformable as the filler 24 moves in the interior. In particular, since the pillow body 2 has the upper part (opposite side with respect to lower part which is defined as the groove part 6 to which the neck lies along) of the head depression part 4 connected at the left and the right, the filler 24 can move greatly to the left and the right. Therefore, in addition to high and low, and left and right inclination of a supporting surface 42 formed as a continuous peripheral surface surrounding the head depression part 4, an inclination degree of an inclined surface 61 extending along the groove part 6 from a lower edge 411 of the head depression part 4 and others can be easily adjusted. Although not shown, the entire pillow body may be formed by low repulsive urethane foam in place of the filler. In this case, the low repulsive foamed polyurethane itself deforms and the entire pillow body becomes freely deformable.

Figure 3:
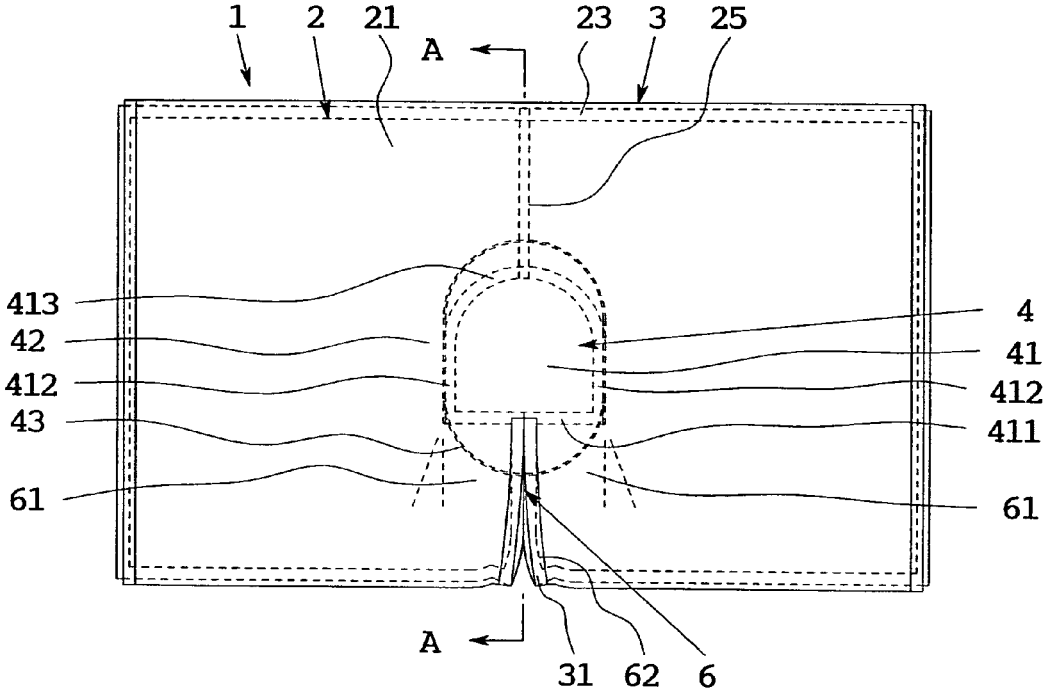
FIG. 3 is a plain view of a pillow of another example.

As another example, as shown in FIG. 3, for example, a separation part 25 extending from the head depression part 4 to the edge cloth 23 of the pillow body 2 and being formed by sewing the upper surface cloth 21 to the lower surface cloth 22 may be formed in a symmetric position with respect to the groove part 6, thereby completely separating the pillow body 2 to the left and the right. The pillow body 2 of another example has an overall configuration in which two parts having a C-shape in plain view and having the head depression part 4 are connected via upper and lower groove part 6 and the separation part 25. The supporting surfaces 42 of another example are formed as discontinuous peripheral surfaces including a plurality of inclined surfaces having a falling gradient towards the head depression part 4. The filler 24 is filled into each of the pair of bags completely separated by the head depression part 4, the groove part 6 and the separation part 25, and thus is movable only within each bag and is prevented from moving between the bags. Accordingly, height or inclination of the each opposing supporting surface 42 of another example is adjusted by each bag. Although it is not shown in the figures, a pair of the left part and the right part having C-shape in plain view may be respectively formed by low repulsive urethane form instead of the filler.

The pillow 1 of the present example includes a tubular pillowcase 3 for covering the pillow body 2, and a thin cushion sheet 43 used by being accommodated at the bottom surface 41 of the head depression part 4. As shown in FIGS. 1 and 2, the cushion sheet 43 of the present example has a straw rice bag shape in plain view of a size enveloping the back of the head, that is, a size covering the bottom surface 41 with a width (about 16 cm in present example) slightly wider than the bottom surface 41 of the head depression part 4. The present example is an example using only one cushion sheet 43. The cushion sheet 43 is used in piles on the bottom surface 41 of the head depression part 4 in order to reduce the uncomfortable feeling that arises when the back of the head directly touches the bottom surface 41 of the head depression part 4. The cushion sheet 43 may be sewed to the bottom surface 41 so as to be prevented from shifting with respect to the bottom surface 41. Greater number of cushion sheets 43 may be accommodated in piles at the bottom surface 41 of the head depression part 4 for every patient with whiplash syndrome, or a thick cushion sheet may be accommodated at the bottom surface 41 of the head depression part 4.

The pillow 1 of the present invention has features in the head depression part 4 and the groove part 6 extending from the head depression part 4. The head depression part 4 of the present example is formed with the bottom surface 41, which is in plane with the lower surface cloth 22 of the pillow body 2, surrounded by the supporting surface 42 which is the continuous peripheral surface comprising the upper surface cloth 21 rising from the periphery of the bottom surface 41. In the present example, the bottom surface 41 of the head depression part 4 is formed with the lower surface cloth 22, and the bottom surface 41 and the lower surface are in plane, and thus the back of the head can deeply sink in. Furthermore, since the bottom surface 41 ties down the supporting surface 42, the supporting surface 42 is maintained to a continuous peripheral surface surrounding the bottom surface 41 thereby supporting the back of the head from the periphery, and fixing the position and the orientation of the back of the head of the patient with whiplash syndrome. If the pillow body is formed with low repulsive urethane foam, the head depression part can be configured as a concave part formed with the low repulsive urethane foam.

The bottom surface 41 of the head depression part 4 has a bell shape in plain view surrounded by a linear lower edge 411 orthogonal to an extending direction of the groove part 6, linear side edges 412 extending orthogonal to the lower edge 411 from both ends of the lower edge 411, and an arch-shaped upper edge 413 of semicircular arc bridged between the ends of the side edges 412. The inclined surface 61 of rising gradient formed along the groove part 6 from the lower edge 411 of the bottom surface 41 may be formed at the width of the lower edge 411 (see FIG. 5). By forming the inclined surface 61 in said width, the inclined surface 61 which does not place a strain on the neck even if the patient with whiplash syndrome moves to the right or left is provided. The function in which the head depression part 4 supports the back of the head with the supporting surface 42 formed as a continuous peripheral surface is influenced by the size of the bottom surface 41. Specifically, the head depression part 4 which stably supports the back of the head with the supporting surface 42 while accepting the back of the head deeply sunk in preferably has the width of the bottom surface 41 to about 12 cm. The width of the bottom surface 41 is determined in the range of between 65% and 80%, and preferably between 70% and 75% of the width of the head of an average person. The length from the linear lower edge 411 to the apex of the arch-shaped upper edge 413 is preferably to be about 15 cm, and is determined in the range of between 40% and 65%, and preferably between 45% and 55% of the length of the head of an average person.

As shown in FIG. 6, a head depression part 5 may have a bottom surface 51 formed to an elliptical shape in plain view surrounded by an arcuate lower edge 511 orthogonal to an extending direction of the groove part 6, linear side edges 512 extending in continuation to the lower edge 511 from both ends of the lower edge 511, and an arch-shaped upper edge 513 bridged between the ends of the side edges 512. The head depression part 5 forms the inclined surface 61 of rising gradient formed along the groove part 6 from the arcuate lower edge 511 so as to envelope the neck of the patient with whiplash syndrome, and restrains the back of the head of the patient with whiplash syndrome without placing a strain on the neck of the patient with whiplash syndrome. Similar to the above, the head depression part 5 preferably has the width of the bottom surface 51 to about 12 cm. The width of the bottom surface 51 is determined in the range of between 65% and 80%, and preferably between 70% and 75% of the head of an average person. The length from the apex of the arcuate lower edge 511 to the apex of the arch-shaped upper edge 513 is preferably to be about 15 cm, and is determined in the range of between 30% and 65%, and preferably between 35% and 55% of the length of the head of an average person.

The groove part 6 is formed by sewing the upper surface cloth 21 depressed towards the lower surface cloth 22 and the lower surface cloth 22, and the inclined surfaces 61 extending from the lower edge 411 of the head depression part 4 are formed on the left side and the right side. When the pillow body is formed with low repulsive urethane foam, the groove part 6 can be formed as a groove having a V-shaped cross-section or a U-shaped cross-section formed with the low repulsive urethane foam. The pillow body 2 of the present example is interiorly filled with movable filler 24, and thus the angle of inclination and planarity, as well as the direction of inclination of the inclined surface 61 raised along the groove part 6 from the lower edge 411 of the bottom surface 41 can be freely adjusted. The groove part 6 thus only has the inclined surfaces 61 formed on the left side and the right side. The inclined surfaces 61 support the left and the right of the neck of the patient with whiplash syndrome. The groove part 6 does not contact, in particular, the middle of the neck along the cervical spine.

The groove part 6 of the present example has a cutout portion 62 formed by cutting both sides of the terminating ends intersecting the edge cloth 23 of the pillow body 2 to the left and the right, so that the portion where the edge cloth 23 and the groove part 6 intersect does not project out and the intersecting portion does not contact the middle of the neck along the cervical spine. The inclined surfaces 61 formed along the groove part 6 support the left and the right of the neck while the groove part 6 forms a portion that does not contact the middle of the neck along the cervical spine on the upper surface of the pillow body 2. Thus, the groove part 6 which restrains the position relation of the left and right inclined surfaces 61 is preferably long while absorbing the tension on both sides of the terminating ends where the edge cloth 23 and the groove part 6 intersect with the cutout portion 62. The length of the cutout portion 62, that is, the length of cutting both sides of the terminating end of the groove part 6 is thus about a few cm, specifically, about 3 cm. With the length of the neck of an average person (length obtained by adding the length from the first cervical spine to the seventh cervical spine) as about 10 cm, the length of the groove part 6 from the lower edge 411 of the bottom surface 41 of the head depression part 4 to the cutout portion 62 is preferably about 15 cm, which is obtained by adding the length of the back of the head to which the inclined surface 61 contacts to the length of the neck.

Similar to the prior art, the pillowcase 3 prevents the pillow body 2 from becoming dirty. The pillowcase 3 of the present example has a tubular shape, and is attached from an open end on both left and right ends to cover the pillow body 2. The positioning in the left and right direction of the pillowcase 3 with respect to the pillow body 2 is facilitated with an annular cutout 31 (closed cutout 31) as a mark with respect to the cutout portion 62. When the tubular pillowcase 3 is formed by wrapping one sheet of cloth, the sewing line extending in the left and right direction forms in the pillowcase 3, which sewing line may be matched with the edge cloth 23 of the pillow body 2 to help the alignment by the cutout 31.

The cutout 31 of the pillowcase 3 is preferably the length obtained by adding the length of cutting both edges of the terminating ends of the groove part 6 to the length of the neck, specifically, about 13 cm obtained by adding the cutting length of 3 cm to the length of the neck of an average person of about 10 cm. In this case, the pillowcase 3 can be opened to the left or the right by matching the lower end side of the cutout 31, which goes around to the lower surface side of the pillow body 2, to the opened edges of the terminating ends of the groove part 6. Owing to the cutout 31 on the pillowcase, the pillowcase 3 does not fill the groove part 6 of the pillow body 2 and does not make pillowcase 3 tense. The pillowcase 3 is tucked in towards the groove part 6 thereby ensuring the function of the groove part 6. In addition, although not shown, the positioning with respect to the pillow body is similarly facilitated and the function of the groove part is ensured by forming the cutout in the pillowcase covering only the upper surface of the pillow body and the bag-shaped pillowcase.

As shown in FIGS. 7 and 8, in the pillow 1 of the present invention, the back of the head 71 of a patient 7 with whiplash syndrome sinks into the head depression part 4, the back of the head 71 is supported with the supporting surface 42 having continuous peripheral surface, the neck 72 of the patient 7 with whiplash syndrome, in particular, the middle of the neck 72 along the cervical spine is laid along the groove part 6, and the neck 72 is supported from the left and the right by the inclined surfaces 61 raised gradually from the bottom surface 41 of the head depression part 4. If the pillow body 2 is filled with the filler 24, the angle of inclination, the direction of inclination of the inclined surface 61 supporting the neck 72 from the left and the right can be adjusted by the movement of the filler 24 by the patient 7 with whiplash syndrome himself/herself so as to fit to the patient's condition, and thus the restraint of the back of the head 71 and the neck 72 of the patient 7 with whiplash syndrome by the head depression part 4 and the groove part 6 does not become too strong, and the neck 72 is merely suppressed to an extent it is not stimulated during sleep. The back of the head 71 and the neck 72 of the patient 7 with whiplash syndrome are thereby prevented from moving with respect to the pillow body 2 during sleep, and a state in which the neck 72 is not applied with pressure can be maintained for a long period of time, whereby a peaceful sleep can be provided to the patient 7 with whiplash syndrome.

The invention claimed is:

1. A pillow having a deformable pillow body comprising an upper surface and a lower surface with an outer edge as a boundary, said pillow further comprising:

a depression part for accommodating a back of a head having a bottom surface in plane with the lower surface of the pillow body at a position depressed from the upper surface towards the lower surface of the pillow body, a groove part in a plane with a lower surface of the pillow and extending from the bottom surface of the depression part to the outer edge of the pillow body and being formed by joining the upper surface of the pillow body to the lower surface of the pillow body, a supporting surface raised from a periphery of the bottom surface of the depression part towards the upper surface of the pillow body, and an inclined surface gradually rises from the bottom surface of said depression part with a rising gradient formed along the groove part at a width of a lower edge of the bottom surface, said inclined surface fitting from the back of the head to a neck without placing a strain on the neck, thereby fixing a position of the back of the head and the neck.

2. The pillow according to claim 1, wherein the pillow body is configured by an integrated molded article of elastic resin formed with the depression part and the groove part.

3. The pillow according to claim 1, wherein the bottom surface of the depression part has a bell shape in plain view surrounded by a linear lower edge orthogonal to an extending direction of the groove part, linear side edges extending in a relation of intersecting the lower edge from both ends of the lower edge, and an arch-shaped upper edge bridged between ends of the both side edges.

4. The pillow according to claim 1, wherein the bottom surface of the depression part has an elliptical shape in plain view surrounded by an arcuate lower edge orthogonal to an extending direction of the groove part, linear side edges extending in continuation to the lower edge from both ends of the lower edge, and an arch-shaped upper edge bridged between ends of both side edges.

5. The pillow according to claim 1, wherein the groove part is formed with a cutout portion by cutting both sides of a terminating end intersecting the outer edge of the pillow body to the left and the right.

6. The pillow according to claim 5, wherein the pillow body is wrapped with a tubular or a rectangular pillowcase, the pillowcase being formed with a closed cutout at a position corresponding to both sides of the terminating end where the groove part of the pillow body intersects the outer edge of the pillow body.

7. The pillow according to claim 1, wherein the pillow body is configured by filling a movable filler into a bag body formed with the depression part and the groove part.

8. A pillow having a deformable pillow body comprising an upper surface and a lower surface with an outer edge as a boundary, said pillow further comprising:

a depression part for accommodating a back of a head having a bottom surface in plane with the lower surface of the pillow body at a position depressed from the upper surface towards the lower surface of the pillow body, a groove part in a plane with a lower surface of the pillow and extending from the bottom surface of the depression part to the outer edge of the pillow body and being formed by joining the upper surface of the pillow body to the lower surface of the pillow body, a supporting surface raised from a periphery of the bottom surface of the depression part towards the upper surface of the pillow body, and an inclined surface gradually rises from the bottom surface of said depression part with a rising gradient formed along the groove part at a width of a lower edge of the bottom surface, said inclined surface fitting from the back of the head to a neck without placing a strain on the neck, thereby fixing a position of the back of the head and the neck, wherein the groove part is formed with a cutout portion by cutting both sides of a terminating end intersecting the outer edge of the pillow body to the left and the right, and the pillow body is covered with a pillowcase for covering at least the upper surface, the pillowcase being formed with an opened cutout at a position corresponding to both sides of the terminating end where the groove part of the pillow body intersects the outer edge.

* * * * *